US008116478B2

(12) United States Patent
Kim et al.

(10) Patent No.: US 8,116,478 B2
(45) Date of Patent: Feb. 14, 2012

(54) APPARATUS AND METHOD FOR BEAMFORMING IN CONSIDERATION OF ACTUAL NOISE ENVIRONMENT CHARACTER

(75) Inventors: Hyun-Soo Kim, Yongin-si (KR); Hanseok Ko, Seoul (KR); Sung-Joo Ahn, Seou (KR); Jounghoon Beh, Seoul (KR); Hyun-Jin Yoon, Seoul (KR)

(73) Assignee: Samsung Electronics Co., Ltd (KR)

( * ) Notice: Subject to any disclaimer, the term of this patent is extended or adjusted under 35 U.S.C. 154(b) by 1067 days.

(21) Appl. No.: 12/013,875

(22) Filed: Jan. 14, 2008

(65) Prior Publication Data

US 2008/0187152 A1 Aug. 7, 2008

(30) Foreign Application Priority Data

Feb. 7, 2007 (KR) ..... 10-2007-0012803

(51) Int. Cl.
*H04R 3/00* (2006.01)

(52) U.S. Cl. ..... 381/92; 381/91; 381/122; 381/168

(58) Field of Classification Search ..... 381/91–92, 381/122, 168

See application file for complete search history.

(56) References Cited

U.S. PATENT DOCUMENTS

| | | | | |
|---|---|---|---|---|
| 4,752,961 | A * | 6/1988 | Kahn | 381/92 |
| 5,581,620 | A | 12/1996 | Brandstein et al. | |
| 7,930,175 | B2 * | 4/2011 | Haulick et al. | 704/226 |
| 2005/0195988 | A1 | 9/2005 | Tashev et al. | |

FOREIGN PATENT DOCUMENTS

| | | |
|---|---|---|
| KR | 1020060043338 | 5/2006 |
| KR | 1020060085392 | 7/2006 |
| KR | 1020060127078 | 12/2006 |

* cited by examiner

*Primary Examiner* — Theresa T Doan
(74) *Attorney, Agent, or Firm* — The Farrell Law Firm, P.C.

(57) ABSTRACT

Disclosed are an apparatus and a method for beamforming in consideration of characteristics of an actual noise environment. The apparatus includes a microphone array having at least microphone, the microphone array outputting a signal input through the microphone; a coherence function generation unit for calculating coherences for input signals according to each space between microphones, calculating averages of the coherences for the same distance, and filtering the calculated averages of the coherences and outputting the resultant values, when an input signal is input; a spatial filter factor calculation unit for calculating and outputting a spatial filter factor by using the filtered average coherences; and a beamforming execution unit for performing a beamforming for the input signals by using the spatial filter factor, thereby outputting a noise-processed signal.

10 Claims, 7 Drawing Sheets

APPARATUS AND METHOD FOR BEAMFORMING IN CONSIDERATION OF ACTUAL NOISE ENVIRONMENT CHARACTER

PRIORITY

This application claims priority under 35 U.S.C. §119(a) to an application entitled "Apparatus and Method for Beamforming in Reflection of Actual Noise Environment Character" filed in the Korean Industrial Property Office on Feb. 7, 2007 and assigned Serial No. 2007-0012803, the contents of which are hereby incorporated by reference.

BACKGROUND OF THE INVENTION

1. Field of the Invention

The present invention relates to a beamforming apparatus and a beamforming method, and more particularly to an apparatus and a method for performing beamforming for an input signal in consideration of an actual noise environment character.

2. Description of the Related Art

In general, a microphone refers to a transducer for converting acoustic signals conveyed through air vibration into electrical signals. With the recent development of robot control technologies, a microphone has been used as a robot audio interface, i.e. a means for freely communicating ideas between a robot and a user. The robot converts speech signals, which are input through a microphone used as a robot audio interface, into electrical signals and analyzes the converted data, thereby recognizing a user's speech. In addition to the robot, a speech recognition apparatus providing a speech recognition service through the equipped microphone has been increasingly developed.

In a case of such a speech recognition apparatus receiving specific speech signals, if a microphone of the apparatus is located to have directivity towards a direction in which the speech signals are input, the speech recognition apparatus can prevent input of noise occurring in a surrounding environment. In this case, only one microphone having a high directivity can also have directivity towards a direction in which specific speech signals are input. However, when a microphone array is formed by arranging a number of microphones instead of one microphone, it is possible to freely acquire a directivity character suitable for user purposes. Therefore, it is common for a speech recognition apparatus to be equipped with a microphone array enabling use of an audio interface.

Meanwhile, when a software process is performed to eliminate noise for speech signals input through a microphone array, beams are formed from the microphone array toward a specific direction according to the software process. In order to achieve a high directivity from a microphone to a desired direction after forming beams by such a microphone array, a beamforming technology is used.

If a high directivity is formed toward the direction in which a user speech is input through the above-described beamforming, speech signals input from the outside of the beams are automatically reduced. Therefore, it is possible to selectively acquire speech signals input from the direction of interest. The microphone array can suppress surrounding noise, such as noise from an indoor computer fan, television sounds, etc, and the partial reverberation retro-reflected from objects, such as furniture and walls. That is, the microphone array can acquire a higher Signal to Noise Ratio (SNR) for speech signals generated from beams of the interesting direction, by using the beamforming technology. Therefore, the beamforming points beams to a sound source and plays an important role in spatial filtering which suppresses all signals input from different directions.

The beamformer performing beamforming for such input signals shows effective performance as it consistently has over all frequency domains. In this case, a beamformer using a Minimum Variance Distortionless Response (MVDR) algorithm is generally used in a noise environment having a stationary character.

A construction by which a beamformer using an MVDR algorithm performs a beamforming operation and outputs a noise-eliminated signal will be described with reference to FIG. 1.

First, when speech signals on the time domain input through the microphone array 100 are transformed into signals on the frequency domain, and the resultant signals are input to the beamforming unit 110, the beamforming unit 110 can derive output values using Equation (1) below.

$$Y(\omega) = \sum_{i=0}^{N-1} X_i(\omega) W_i(\omega) \tag{1}$$

In Equation (1), N denotes the number of microphones constituting the microphone array 100, $X_i(\omega)$ represents an $i^{th}$ input signal on the frequency domain from among N microphones. Also, a filter factor called $W_i$ of Equation (1) is determined depending on a model format defining a noise environment.

The MVDR algorithm based on a minimum variance solution is widely used as an algorithm for performing beamforming so as to suppress noise from all directions except for a desired direction of input signals in the microphone array 100.

A filter factor value 'W' for performing beamforming through such an MVDR algorithm is defined by Equation (2) below.

$$W = \frac{\Gamma^{-1} d}{d^H \Gamma^{-1} d} \tag{2}$$

In Equation (2), d is a vector affecting decision of the direction so that microphone array 100 is oriented toward a sound source. In a Uniform Linear microphone Array (ULA) arranged with a same distance between adjacent microphones, d can be expressed as defined by Equation (3) below.

$$d=[d_1 d_2 \ldots d_n]^{\Gamma} \tag{3}$$

In Equations (2) and (3), $$d_n = \exp\left(-j\frac{\omega d}{c}(n-1)\cos\theta\right),$$

c represents the speed of sound, n represents a serial number of a corresponding microphone, d represents distance between microphones, and θ represents an angle of incident speech signals with respect to the array. Γ represents a coherence matrix, which can be expressed by Equation (4) below.

$$\Gamma = \begin{pmatrix} 1 & \Gamma_{X_0 X_1} & \cdots & \Gamma_{X_0 X_{N-1}} \\ \Gamma_{X_1 X_0} & 1 & \cdots & \Gamma_{X_1 X_{N-1}} \\ \vdots & \vdots & \ddots & \vdots \\ \Gamma_{X_{N-1} X_0} & \Gamma_{X_{N-1} X_1} & \cdots & 1 \end{pmatrix} \quad (4)$$

In Equation (4), each component of the coherence matrix corresponds to coherence for the input $X_0X_1$, which can be defined by Equation (5) below. Herein, $\Phi$ represents Power Spectral Density (PSD) between two input noise signals.

$$\Gamma_{X_0 X_1}(\omega) = \frac{\Phi_{X_0 X_1}(\omega)}{\sqrt{\Phi_{X_0 X_0}(\omega)\Phi_{X_1 X_1}(\omega)}} \quad (5)$$

That is, performance of the beamforming unit 110 is determined according to a spatial character of only an input signal. Therefore, if a coherence of a noise environment is well defined, it is possible to effectively improve the performance of the beamforming unit 110.

Generally, in an indoor noise environment, signals are retro-reflected and diffused due to obstacle, such as walls, and furniture. Therefore, signals input from all directions of a noise environment to the microphone are regarded to have constant power, which is called a diffuse environment. If $d_{ij}$ represents a space between a microphone i and a microphone j, a coherence in an ideal diffuse environment can be defined by using a sinc function as shown in equation (6). Coherences are calculated by using the sinc function as shown in equation (6) below and the resultant values are applied to a beamformer, which is called a super-directive beamformer.

$$\Gamma_{X_i X_j}(\omega) = \mathrm{sinc}\left(\frac{\omega d_{ij}}{c}\right) \quad (6)$$

As such, a conventional beamformer calculates coherences by applying the above-described Equation (6) using the sinc function, which is fixed regardless of data based on an actual noise magnitude. By using the calculated coherences, the beamformer is employed and applied to a noise filtering.

As described above, since an indoor environment, such as a house or an office has a reverberant character against signals, the environment can be assumed as a diffuse environment. However, an actual coherence significantly changes according to a noise environment, as shown in FIG. 2, so that there is much difference between the actual coherence and a fixed sinc function. Referring to FIG. 2, as much error as the hatched area occurs between the sinc function and an actual coherence measured by a microphone.

If a speech recognition apparatus is placed at an ideal diffuse environment and speech signals are input from such a diffuse environment to the speech recognition apparatus, a coherence between two input signals on the low frequency domain must be approximated to have a value of 1. However, the coherence has practically different values depending on a position and a space at which the microphones are arranged. Even if the same kind of microphone is used, each microphone has a different gain. An actual measurement coherence may have frequently different values since the microphone itself generates noise.

However, a coherence used in a current beamformer corresponds to a coherence calculated by using only a fixed sinc function regardless of an actual noise environment, as shown in Equation (6). Therefore, as shown in FIG. 2, as much error as the hatched area occur as compared with coherences calculated by reflecting a sinc function and an actual noise environment. Accordingly, if a beamforming unit 110 is implemented by simply applying only a sync function, it is difficult to acquire optimal performance.

SUMMARY OF THE INVENTION

Accordingly, the present invention has been made to solve the above-mentioned problems occurring in the prior art, and the present invention provides a beamforming apparatus and a beamforming method for achieving an effective spatial filtering by employing a beamformer reflecting an actual noise environment character.

The present invention also provides a beamforming apparatus and a beamforming method for calculating a coherence value in consideration of an actual noise environment.

In accordance with an aspect of the present invention, there is provided an apparatus for beamforming in consideration of an actual noise environment character, the apparatus including a microphone array having at least microphone, the microphone array outputting a signal input through the microphone; a coherence function generation unit for calculating coherences for input signals according to each space between microphones, calculating averages of the coherences for the same distance, and filtering the calculated averages of the coherences and outputting the resultant values, when an input signal is input; a spatial filter factor calculation unit for calculating and outputting a spatial filter factor by using the filtered average coherences; and a beamforming execution unit for performing beamforming for the input signals by using the spatial filter factor, thereby outputting a noise-processed signal.

In accordance with another aspect of the present invention, there is a method for beamforming in consideration of an actual noise environment in a speech recognition apparatus equipped with a microphone array including at least one microphone, the method including when an input signal is input to the microphone, calculating coherences for the input signal according to spaces between microphones, and calculating averages of the coherences for each same distance between the microphones; filtering the calculated averages of the coherences and calculating a spatial filter factor by using the filtered average coherences; and performing beamforming for the input signal by using the spatial filter factor, thereby outputting a noise-processed signal.

BRIEF DESCRIPTION OF THE DRAWINGS

The above and other aspects, features and advantages of the present invention will be more apparent from the following detailed description taken in conjunction with the accompanying drawings, in which.

DETAILED DESCRIPTION OF THE EXEMPLARY EMBODIMENT

Hereinafter, an exemplary embodiment of the present invention will be described with reference to the accompanying drawings. In the following description, a detailed description of known functions and configurations incorporated herein will be omitted when it may make the subject matter of the present invention rather unclear.

The present invention provides a method which, in a speech recognition apparatus equipped with a microphone array including a plurality of microphones, reflects a noise character of an actual environment to a beamformer by analyzing a signal input from each of the microphones, calculating the coherence in consideration of the actual environment noise character, and applying the resultant values to the beamformer.

Figure 1:
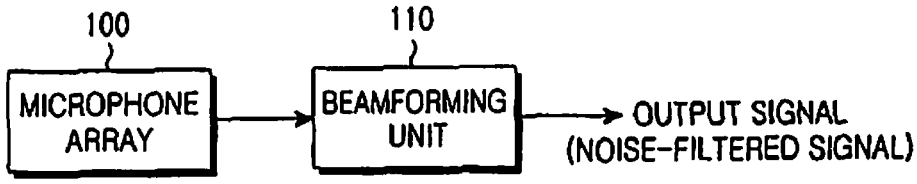
FIG.1 (PRIOR ART)
FIG. 1 is a block diagram illustrating an internal construction of a speech recognition apparatus performing a beamforming operation for an input signal according to the prior art.
Figure 2:
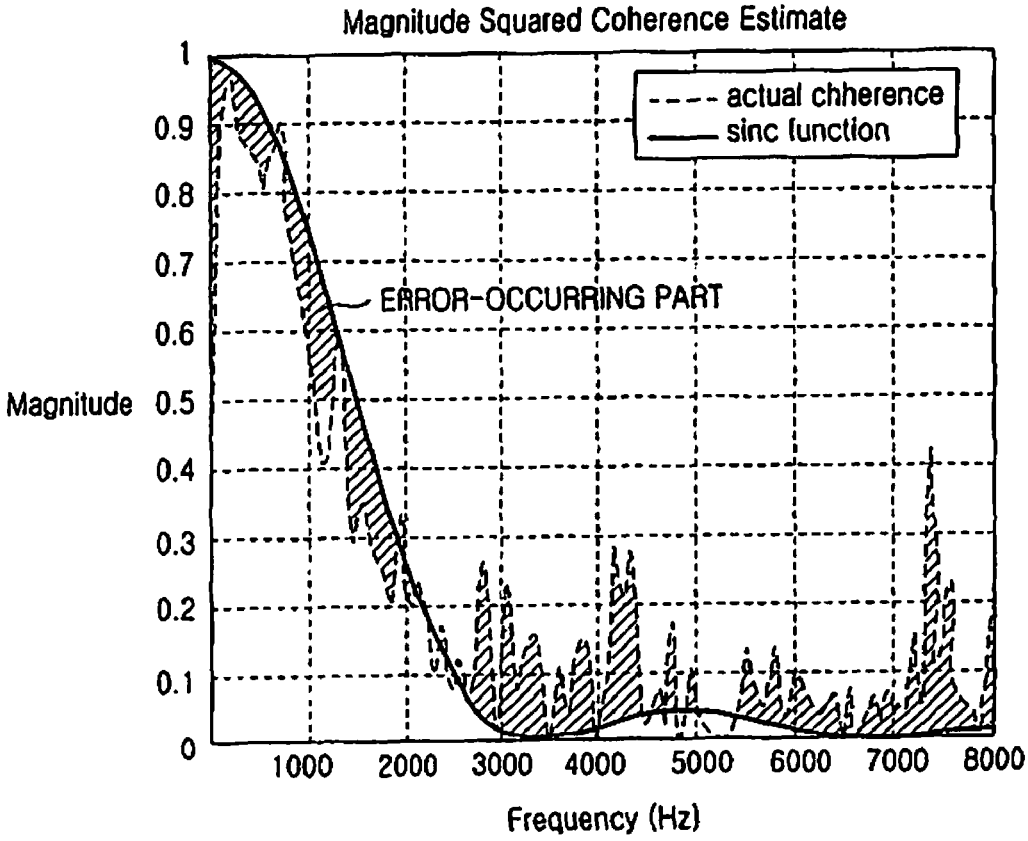
FIG.2 (PRIOR ART)
FIG. 2 is a graph illustrating a sinc function and an actual coherence measured by a microphone.
Figure 3:
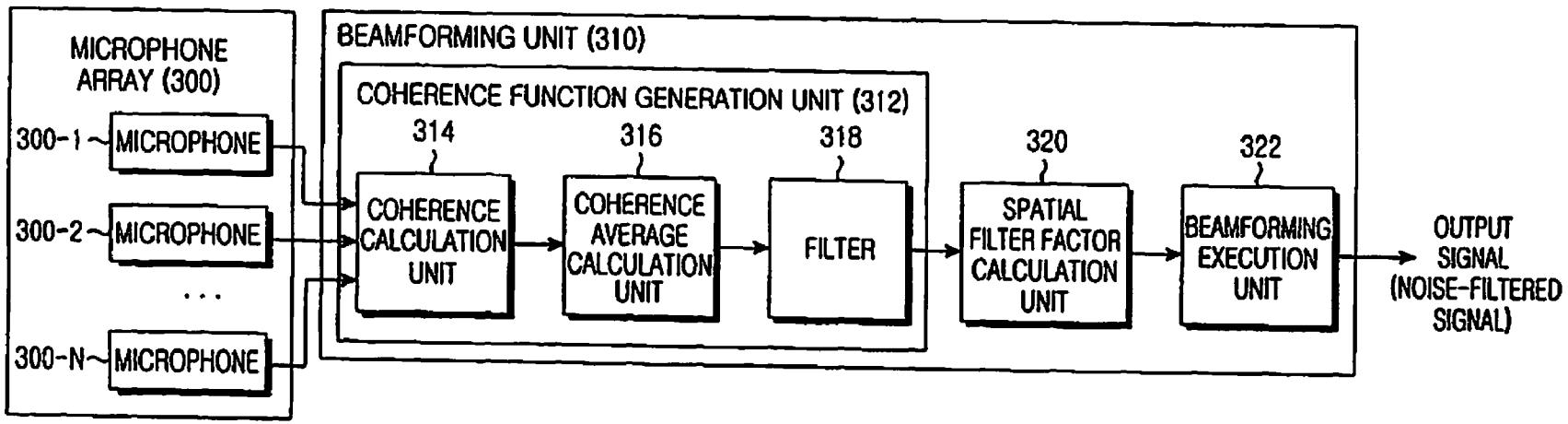
FIG. 3 is a block diagram illustrating an internal construction of a speech recognition apparatus performing beamforming in consideration of an actual noise environment character, according to an embodiment of the present invention.

Hereinafter, an internal construction of a speech recognition apparatus for performing beamforming in consideration of an actual environment noise character according to an embodiment of the present invention will be described with reference to FIG. 3. The speech recognition apparatus includes a microphone array 300 and a beamforming unit 310.

First, the microphone array 300 includes a plurality of microphones 300-1 to 300-N, which are linearly arranged with the same space between the microphones to each receive an input signal. In this case, the input speech signals corresponding to input signals having noise and speech, and each of the microphones outputs the input signal to the beamforming unit 310.

The beamforming unit 310 receives a signal input from each of microphone arrays 300-1 to 300-N and calculates coherences for a noise section of the input signal according to a space of each microphone. Then, the beamforming unit 310 calculates averages of the coherences, which are obtained from each same distance, and performs the filtering so as to smoothen a rapidly changing part in the average coherence function. Then, the beamforming unit 310 calculates a beamforming spatial filter factor by using the filtered coherence, performs beamforming for the input signal by using the calculated spatial filter factor, thereby outputting a noise-processed signal.

The beamforming unit 310 includes a coherence function generation unit 312 having a coherence calculation unit 314, a coherence average calculation unit 316, and a filter 318, a spatial filter factor calculation unit 320, and a beamforming execution unit 322. Hereinafter, a detailed operation for respective constructions of the beamforming unit 310 will be described.

First, the coherence calculation unit 314 analyzes a signal input from each of the microphones 300-1 to 300-N, and calculates coherences according to a space between microphones. The coherences calculated according to the space between microphones are input to the coherence average calculation unit 316, and the coherence average calculation unit 316 calculates an average value of the input coherences obtained from the same distance. That is, each coherence average value is calculated according to the same distance between the microphones.

Then, the coherence average values for each same distance calculated by the coherence average calculation unit 316 are input to the filter 318, and the filter 318 performs the filtering of the input average values to be smoothened and outputs the resultant values.

The spatial filter factor calculation unit 320 calculates the spatial filter factor for beamforming by using the input coherences. In this case, calculation of the spatial filter factor through the coherences will be described in more detail by Equation (9) below.

Such a spatial filter factor calculated from the spatial filter factor calculation unit 320 is input to the beamforming execution unit 322, and the beamforming execution unit 322 removes noise from the input signal through the spatial filtering process using the calculated spatial filter factor and outputs a noise-filtered signal.

Now, a beamforming operation for signals input to a microphone array including four microphones, for example, will be described.

First, the coherence calculation unit 314 calculates three coherence functions for input signals, received to each of four microphones, based on the each distance between microphones. In this case, since it is assumed that the number of microphones is four, three coherence functions are calculated. If the number of microphones is N, the number of coherences to be calculated between adjacent microphones is N−1. Moreover, under an assumption that a preceding part of a signal input to the microphones (for example, about 20 frames) is a noise section, the coherence is calculated by using Equation (5) with the signal of the noise section after subjecting the input signal to a discrete Fourier transform.

Figure 4:
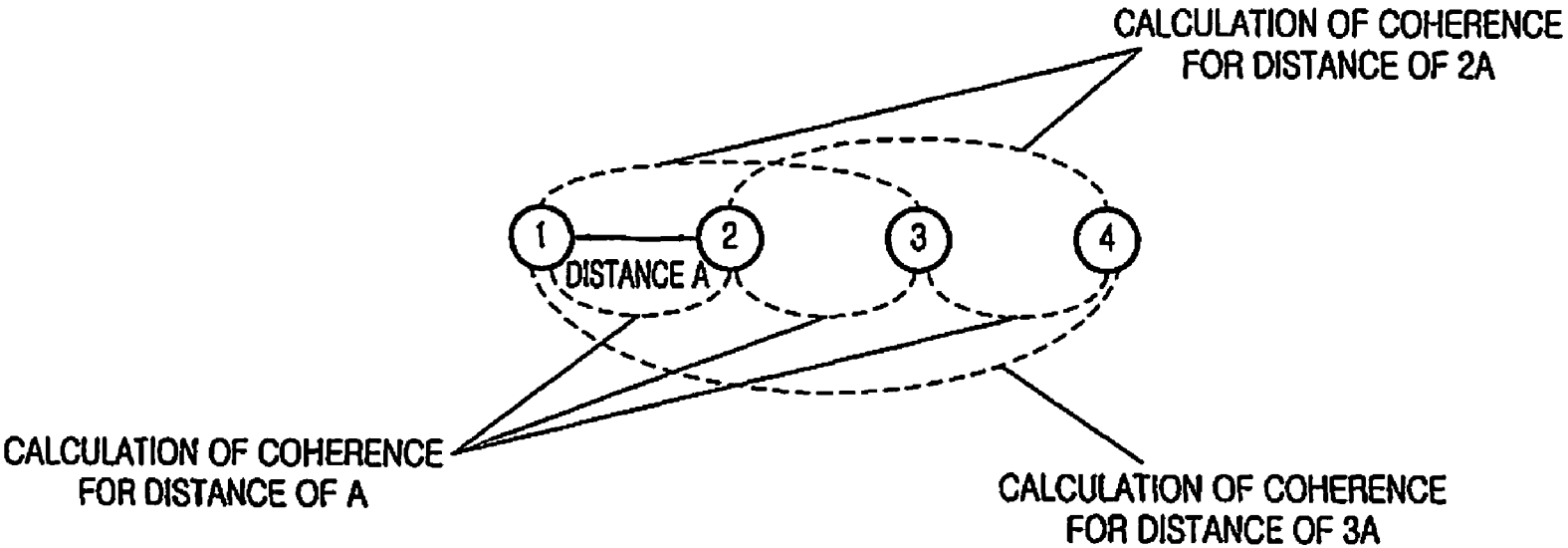
FIG. 4 is an exemplary view illustrating how coherences between microphones are calculated in a microphone array including four microphones.
Figure 5:
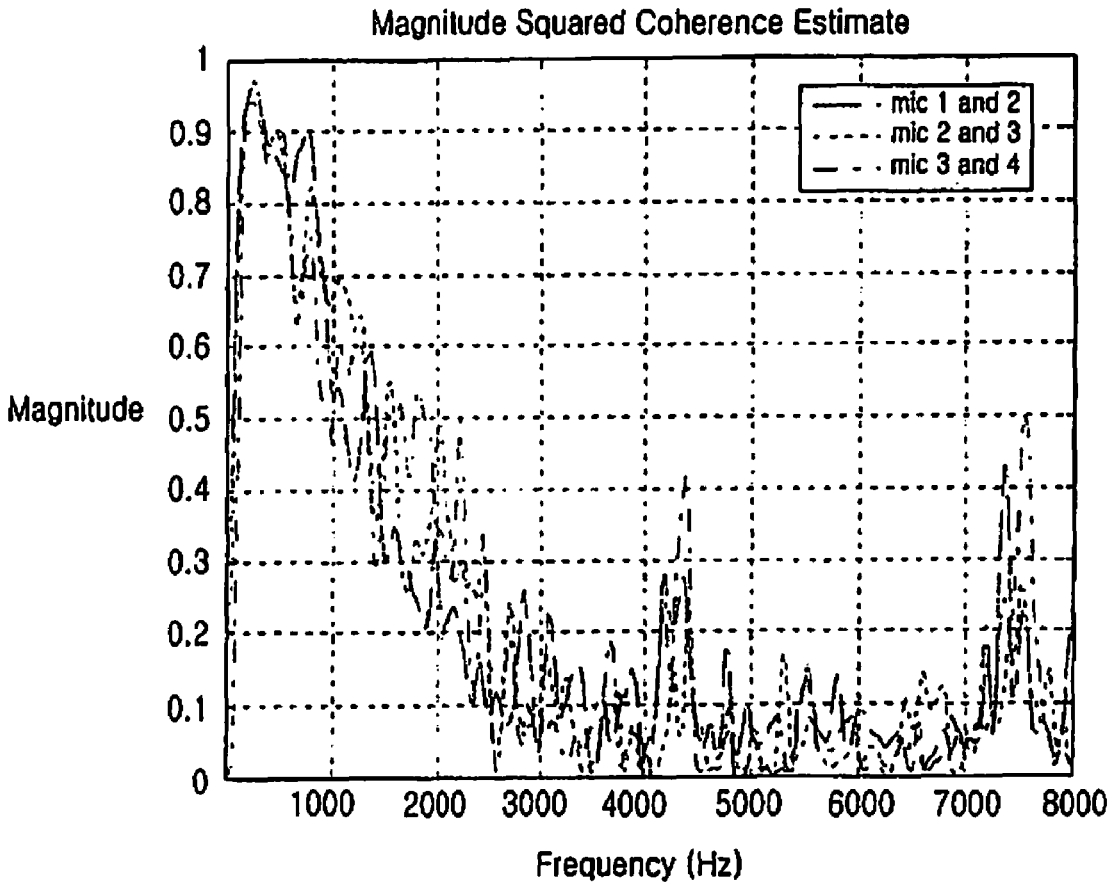
FIG. 5 is a graph illustrating coherence functions calculated by each microphone having the same construction of FIG. 4.

FIG. 5 illustrates three coherences that the coherence calculation unit 314 calculates between adjacent microphones. That is, if a microphone array is arranged as shown in FIG. 4, a coherence between first and second microphones, a coherence between second and third microphones, and a coherence between third and fourth microphones are calculated respectively.

The coherence between adjacent microphones arranged with the same space has the similar distribution as shown in FIG. 5. In this case, if coherences of all cases are independently calculated and the resultant values are reflected to the beamforming unit 310, as the number of the used microphones increases, the operation amount increases, thereby increasing the time delay in signal processing. Therefore, in order to reduce the calculation amount while the robustness for noise filtering of the beamforming unit 310 is maintained, the coherences of the same distance calculated by the coherence average calculation unit 316 are mixed and the mixed values are averaged. In FIG. 4, the number of the coherences calculated between all microphones is six. However, the same distance can be represented as a, 2*a*, and 3*a*, and the coherence average values for respective distances are calculated, and thus the number of the coherences is three.

That is, the coherence average calculation unit 316 calculates the coherence average values for the same distance between the microphones by Equation (7).

In the coherence matrix of equation (6), respective components are determined according to the distance between two microphones. As shown in FIG. 4, it is assumed that the distance between microphones is a. Then, each distance between four microphones corresponds to a, 2*a*, and 3*a*, and thus coherences of three cases are required. In this case, three coherences of $\Gamma_{d_1}, \Gamma_{d_2}, \Gamma_{d_3}$ can be calculated as defined by Equation (7) below.

$$\begin{aligned} \Gamma_{d_1}(\omega) &= \frac{(\Gamma_{X_0X_1}(\omega) + \Gamma_{X_1X_2}(\omega) + \Gamma_{X_2X_3}(\omega))}{3} \\ \Gamma_{d_2}(\omega) &= \frac{(\Gamma_{X_0X_2}(\omega) + \Gamma_{X_1X_3}(\omega))}{2} \\ \Gamma_{d_3}(\omega) &= \Gamma_{X_0X_3}(\omega) \end{aligned} \tag{7}$$

When the number of the microphones used in the microphone array is four, the average values of coherences for each of a, 2*a*, and 3*a* having the same distance are defined by Equation (7). That is, because there are three coherences having a distance of a, three average values are calculated. Because there are two coherences having a distance of 2*a*, two average values are calculated. Also, because there is only one coherence having a distance of 3*a*, it is possible to use the coherence having a distance of 3*a* as it is without calculating a separate average value.

Figure 7:
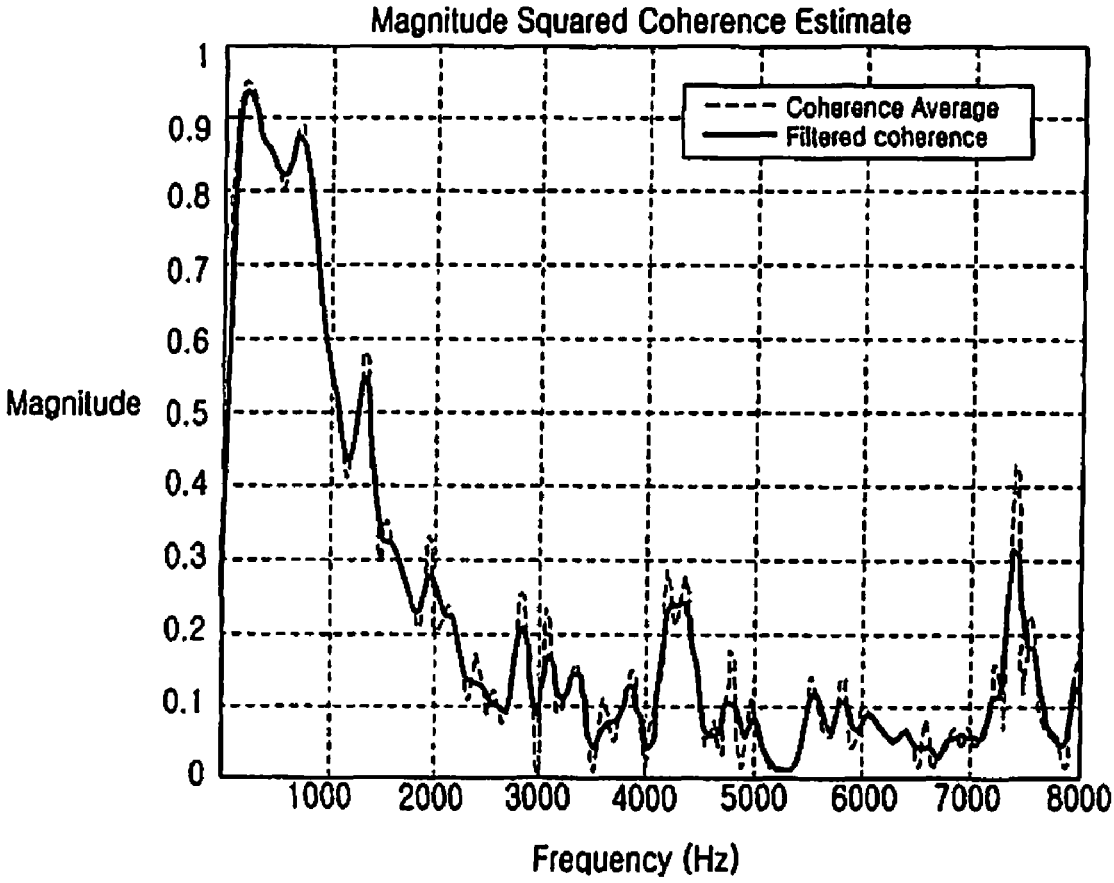
FIG. 7 is a graph illustrating average coherences calculated by using a moving average filter according to an embodiment of the present invention.

Also, Equation (7) may be differently applied according to the number of the microphones. For example, when the number of microphones is six, there are five spaces of a to 5*a* between microphones. Therefore, five combinations can be calculated. Also, respective average coherences calculated according to the same distance between each of the microphones also have a great fluctuation width in the range of the whole frequency bandwidth, as expressed by the dotted lines in the graph of FIG. 7.

Therefore, errors caused by sensitivity of the coherence rapidly changing depending on frequencies are reduced, and a filtering operation is performed in the filter 318 so as to smooth a width of a coherence function varying according to frequencies. In this case, in order to smoothen rapid changing coherences by performing the filtering of the average coherences, one of the following methods can be used. The methods include a first method of applying a moving average filter, a second method for subjecting the coherence function to Fourier transform and passing the resultant function through a Low Pass Filter (LPF), a third method using a median filter, and a fourth method using one dimensional Gaussian smoothing filter.

When the coherence function has a smoothened curve by applying the moving average filter, i.e. the first method of the filtering methods, the filtering can be performed as shown in equation (8) below.

$$\hat{\Gamma}_{d_i}(\omega_n) = h\sum_{i=0}^{2}\Gamma_{d_i}(\omega_{n-i}) \tag{8}$$

In Equation (8), k=1, 2, 3, h=⅓, and n represents an index for a frequency.

The coherences filtered by the filter 318 are input to the spatial filter factor calculation unit 320. Then, the spatial filter factor calculation unit 320 calculates a beamforming spatial filter factor by using the input coherences.

Hereinafter, an operation for calculating a beamforming spatial filter factor by using the coherences input from the spatial filter factor calculation unit 320 will be described in more detail.

In the coherence matrix as shown in Equation (4), since the averages for the coherences obtained from the microphones arranged between the same distance is calculated, it can be said that $\Gamma_{X_0X_1}=\Gamma_{X_1X_2}=\Gamma_{X_2X_3}$. Moreover, the coherence matrix can be expressed by using only three $\hat{\Gamma}_{d_1}, \hat{\Gamma}_{d_2}, \hat{\Gamma}_{d_3}$, as defined by Equation (9) below.

$$\Gamma_{MA} = \begin{pmatrix} 1 & \hat{\Gamma}_{d_1} & \hat{\Gamma}_{d_2} & \hat{\Gamma}_{d_3} \\ \hat{\Gamma}_{d_1} & 1 & \hat{\Gamma}_{d_1} & \hat{\Gamma}_{d_2} \\ \hat{\Gamma}_{d_2} & \hat{\Gamma}_{d_1} & 1 & \hat{\Gamma}_{d_1} \\ \hat{\Gamma}_{d_3} & \hat{\Gamma}_{d_2} & \hat{\Gamma}_{d_1} & 1 \end{pmatrix} \tag{9}$$

The spatial filter factor calculation unit 320 calculates spatial filter factors for beamforming by applying the coherence matrix as shown in Equation (9) to the above-described Equation (2).

Then, the beamforming execution unit 322 performs beamforming for the input signal in consideration of the calculated spatial filter factors. In this case, a signal output through the beamforming execution unit 322 can be calculated by Equation (1). In this case, the output signals are subjected to an inverse discrete Fourier transform so as to obtain a noise-eliminated waveform.

Figure 8A:
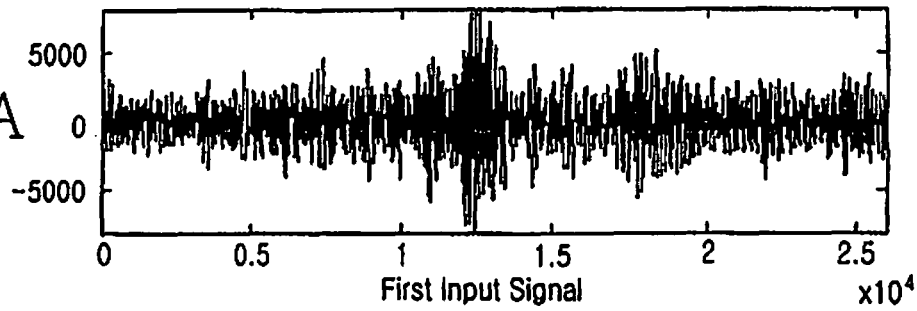
FIG. 8A is a view illustrating a waveform of an actual input signal.
Figure 8B:
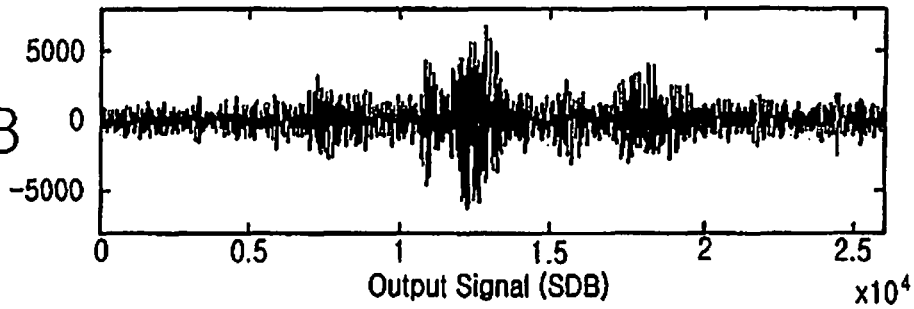
FIG. 8B is a view illustrating a waveform of an output signal obtained by performing beamforming by using coherences calculated through a sync function according to the prior art.
Figure 8C:
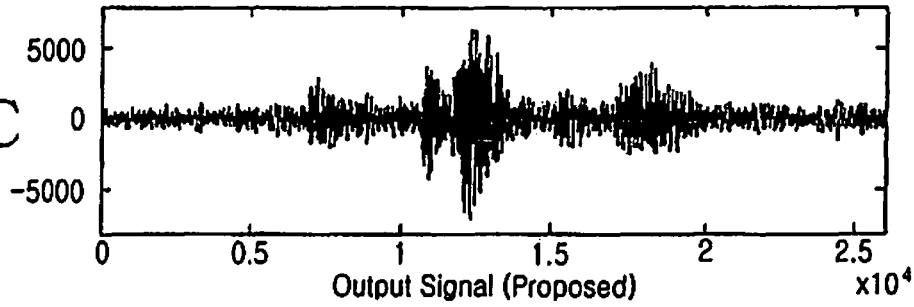
FIG. 8C is a view illustrating a waveform of an output signal obtained by performing beamforming in consideration of an actual noise environment character according to an embodiment of the present invention.

FIG. 8C is a view illustrating a waveform of an output signal obtained by calculating the coherence in consideration of an actual noise environment character, and performing beamforming for the input signals through the spatial filter factors by the calculated coherences.

FIG. 8A illustrates an actual input signal generated when a user speaks a word in front of the microphone array while four arranged microphones continually reproduce a noise in the direction of 60 degrees away from the side of the microphone array. FIG. 8B illustrates an output waveform of an output signal obtained by calculating a coherence factor through a conventional fixed sinc function and performing beamforming for the input signal through the calculated coherence factor.

As noted from FIGS. 8B and 8C, the output waveform of FIG. 8C according to the present invention shows a noise removal performance better than that of FIG. 8B.

Figure 6:
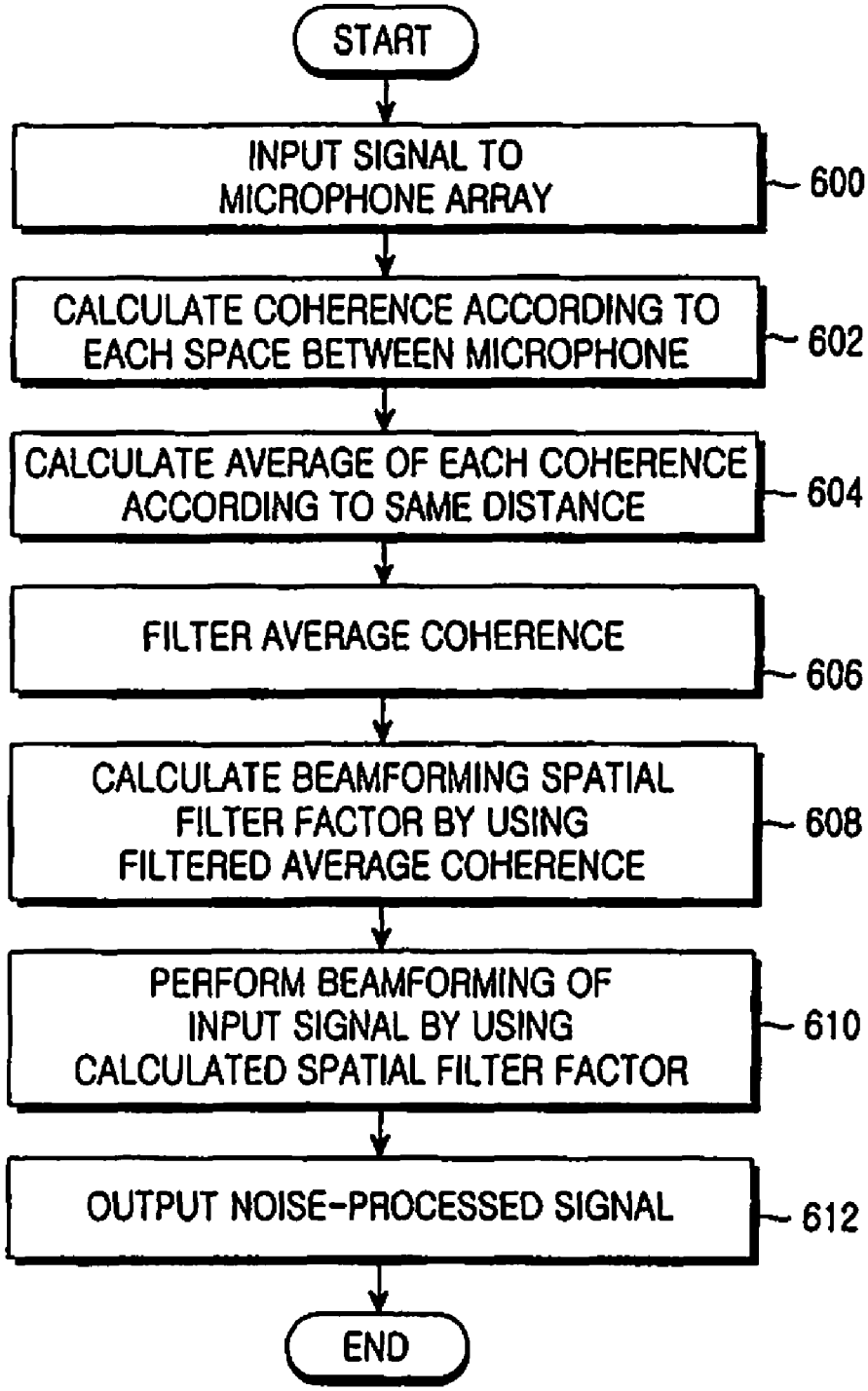
FIG. 6 is a flow diagram illustrating, in consideration of an actual noise environment, a process for performing beamforming in a speech recognition apparatus according to an embodiment of the present invention.

Now, a process by which a speech recognition apparatus having the same construction of FIG. 3 performs beamforming in consideration of an actual noise environment will be described with reference to FIG. 6.

In step 600, a speech signal is input through respective microphones constituting the microphone array 300, and the input signal is output to the coherence calculation unit 314 of the beamforming unit 310.

In step 602, the coherence calculation unit 314 calculates coherences for a noise section of the input signal between each space of microphones and outputs the resultant values to the coherence average calculation unit 316. Herein, a detailed operation for calculating coherences according to each space of microphones will be described with reference to the description of the coherence calculation unit 314 of FIG. 3.

In step 604, the coherence average calculation unit 316 calculates averages of input coherences according to the same distance and outputs the resultant values to the filter 318.

In step 606, the filter 318 performs the filtering of the input average coherence so as to smoothen a rapidly changing part in the average coherence function. In this case, the filtering method can be achieved by selecting one of the four filtering methods described above in relation to the filter 318 of FIG. 3.

In step 608, the spatial filter factor calculation unit 320 calculates a beamforming spatial filter factor by using the filtered average coherence, as shown in Equation (9).

In step 610, the beamforming execution unit 322 performs beamforming of the input signals by using the calculated spatial filter factor. In step 612, a noise-processed signal is output.

In the present invention as described above, when a beamformer performs beamforming of signals input through a microphone array, the coherence is applied to the beamformer in consideration of an actual noise environment. Therefore, it is possible to improve the performance of indoor noise removal. In the present invention, since a relatively simple operation formula is used in calculating coherences in consideration of an actual noise environment, it is possible to rapidly process speech signals which are frequently input to the microphone array and acquire output signals. Moreover, the beamforming technology of a microphone array according to the present invention provides a basis so that an audio interface technology, used between a person and either a robot, a computer, or a mobile device, can be effectively applied to a noisy environment.

While the invention has been shown and described with reference to a certain exemplary embodiment thereof, it will be understood by those skilled in the art that various changes in form and details may be made therein without departing from the spirit and scope of the invention as defined by the appended claims.

What is claimed is:

1. An apparatus for beamforming in consideration of characteristics of an actual noise environment, the apparatus comprising:

a microphone array having at least one microphone, the microphone array outputting a signal input through each microphone;

a coherence function generation unit for calculating coherences for input signals according to distances between the microphones, calculating averages of the coherences for the microphones having the same distance between each other, and filtering the calculated averages of the coherences and outputting the resultant values, when an input signal is input;

a spatial filter factor calculation unit for calculating and outputting a spatial filter factor by using the filtered average coherences; and a beamforming execution unit for performing beamforming for the input signals by using the spatial filter factor, thereby outputting a noise-processed signal.

2. The apparatus as claimed in claim 1, wherein the microphone arrays are linearly arranged with the same space.

3. The apparatus as claimed in claim 1, wherein the input signal corresponds to a speech signal including a noise section and a speech section.

4. The apparatus as claimed in claim 3, wherein the coherence function generation unit comprises:

a coherence calculation unit for calculating coherences for the noise section of the input signal according to each distance between microphones, and outputting the resultant values;

a coherence average calculation unit for calculating averages of the coherences, which are input from the coherence calculation unit, for the same distance and outputting the resultant values; and a filter for filtering the calculated averages of the coherences so as to smoothen the averages of the coherences rapidly changing depending on frequencies.

5. The apparatus as claimed in claim 4, wherein the averages calculated from the coherence average calculation unit are obtained by calculating an average of coherences for the same distance between each of pairs of microphones.

6. The apparatus as claimed in claim 4, wherein the filtering is performed by using one of a first method of applying a moving average filter, a second method for subjecting the coherence function to Fourier transform and passing the resultant function through a Low Pass Filter (LPF), a third method using a median filter, and a fourth method using a one dimensional Gaussian smoothing filter.

7. A method for beamforming in consideration of an actual noise environment in a speech recognition apparatus equipped with a microphone array including at least one microphone, the method comprising the steps of:

when an input signal is input to the array of microphones, calculating coherences for the input signal according to distances between the microphones, and calculating averages of the coherences for the microphones each having the same distance between each other;

filtering the calculated averages of the coherences and calculating a spatial filter factor by using the filtered average coherences; and performing beamforming for the input signal by using the spatial filter factor, thereby outputting a noise-processed signal.

8. The method as claimed in claim 7, wherein, when coherences for the input signal according to each space between the microphones are calculated, the coherences for a noise section of the input signal are calculated.

9. The method as claimed in claim 7, wherein the averages of the coherences for the microphones having the same distance between each other are calculated according to each possible pairing of the microphones.

10. The method as claimed in claim 7, wherein the filtering of the calculated average coherences is performed by using one of a first method of applying a moving average filter, a second method for subjecting the coherence function to a Fourier transform and passing a resultant function through an LPF, a third method using a median filter, and a fourth method using a one dimensional Gaussian smoothing filter.

* * * * *